US006312145B1

(12) United States Patent
Rhoad

(10) Patent No.: US 6,312,145 B1
(45) Date of Patent: Nov. 6, 2001

(54) CAMOUFLAGE LIGHT COVER

(76) Inventor: Don F. Rhoad, 245 Berte Carter Dr., Bamberg, SC (US) 29003

( * ) Notice: Subject to any disclaimer, the term of this patent is extended or adjusted under 35 U.S.C. 154(b) by 0 days.

(21) Appl. No.: 09/067,886

(22) Filed: Apr. 28, 1998

(51) Int. Cl.[7] ..... F21V 3/00

(52) U.S. Cl. ..... 362/311; 362/311; 362/509; 362/455; 362/433

(58) Field of Search ..... 362/311, 312, 362/257, 61, 509, 510, 319, 361, 455, 433

(56) References Cited

U.S. PATENT DOCUMENTS 1,720,531 * 7/1929 Siegel ..... 362/311
3,130,949 * 4/1964 Erhardt et al. ..... 362/365
4,779,167 * 10/1988 Nelson ..... 362/249

* cited by examiner

*Primary Examiner*—Sandra O'Shea
*Assistant Examiner*—Bertrand Zeade

(57) ABSTRACT

A new Camouflage Light Cover for offering a device which disguises headlights and lenses of a vehicle such as a military vehicle, hunting vehicle, ATV, or the like. The inventive device includes a lens cover, a snap-on attachment means, a spring system, pressure standoffs, and heat dissipating standoffs, and is quickly removable when absolutely necessary. Camouflage light covers are for use with military and hunting vehicles and transportation devices to conceal the lights, fixtures, mounting equipment, and other apparatus used to secure the lights, from other people, animals, and other viewing devices that may view the vehicle or other transportation devices. In reference to camouflage light covers, the same procedures and disclosures described in the present invention of camouflaged light covers can be extended to include any printed light covers using the same methods and techniques as those used or employed in the present invention of camouflage light covers and the prior invention of camouflage eyewear.

12 Claims, 2 Drawing Sheets

CAMOUFLAGE LIGHT COVER

BACKGROUND OF THE INVENTION

1. Discussion of Background

Seasoned hunters and specialized military personnel understand the need to cover their vehicles with paint and materials that blends into the surrounding environment. Coverage of the vehicles lights with a camouflage material is especially important so that the reflection and/or glint from the lights will not give away a position. Therefore, it is important to the success of the person desiring not to be seen to effectively cover or camouflage the lights of the vehicles and other transportation devices.

2. Field of the Invention

Basically, the present invention relates to camouflage light covers for vehicles and other transportation devices. In more detail, the present invention relates to camouflage covers that attach to the headlights, tail lights, signal lights, and navigating lights of vehicles and other transportation devices.

The present invention relates to lens covers, blinds, shades, and the like and more particularly pertains to a new Camouflage Light Cover for offering a device which disguises headlights and lenses of a vehicle such as a military vehicle, hunting vehicle, ATV, or the like. The main purpose for the inventive device is for unlit lights or lights that are not in current use, where the inventive device is for taking away reflections from other light sources that happen to shine on the head light lens(lenses) or other lenses, therefore preventing revelation of location which in turn is vital to the conduction of tactical military maneuvers. The inventive device substantially eliminates or reduces glint and reflection from headlight lenses and the like.

DESCRIPTION OF THE PRIOR ART

The use of lens covers, blinds, shades, and the like is known in the prior art. More specifically, lens covers, blinds, shades, and the like heretofore devised and utilized are known to consist basically of familiar, expected and obvious structural configurations, notwithstanding the myriad of designs encompassed by the crowded prior art which have been developed for the fulfillment of countless objectives and requirements.

Known prior art lens covers, blinds, shades, and the like include U.S. Pat. No. 4,673,609; U.S. Pat. No. 5,521,655; U.S. Pat. No. 5,055,982; U.S. Pat. No. 4,894,761; U.S. Pat. No. 4,715,702; U.S. Pat. No. 4,439,817; U.S. Pat. No. 4,310,872; U.S. Pat. No. 4,225,904; U.S. Pat. No. 3,696,238; U.S. Pat. No. 3,259,737; U.S. Pat. No. 2,807,711; U.S. Pat. No. 2,734,129; U.S. Pat. No. 2,596,879; U.S. Pat. No. 2,550,594; U.S. Pat. No. 2,544,378; U.S. Pat. No. 2,539,819; U.S. Pat. No. 2,499,555; and U.S. Pat. No. 1,684,720; and British Patents 2,032,417A and 2,118,096. This application will replace Provisional Application 60/049,036 filed on Jun. 9, 1997 by Don F. Rhoad, 245 Berte Carter Drive, Bamberg, S.C. 29003.

While these devices fulfill their respective, particular objectives and requirements, the aforementioned patents do not disclose a new Camouflage Light Cover. Referring to use on military vehicles and the like, currently mud or sand bags and other objects are used to hide and cover headlight lenses. Upon needing to use the lights, these objects need to be taken off or moved. The inventive device includes a lens cover, a snap-on attachment means, a spring system, pressure standoffs, and heat dissipating standoffs, and is quickly removable when absolutely necessary.

In these respects, the Camouflage Light Cover according to the present invention substantially departs from the conventional concepts and designs of the prior art, and in so doing provides an apparatus primarily developed for the purpose of offering a device which disguises headlights and lenses of a vehicle such as a military vehicle, hunting vehicle, ATV, or the like.

SUMMARY OF THE INVENTION

In view of the foregoing disadvantages inherent in the known types of lens covers, blinds, shades, and the like now present in the prior art, the present invention provides a new Camouflage Light Cover construction wherein the same can be utilized for offering a device which disguises headlights and lenses of a vehicle such as a military vehicle, hunting vehicle, ATV, or the like.

According to its major aspects and broadly stated, the present invention is camouflage covers for vehicles and other transportation devices. Further, the present invention is camouflaged light covers for vehicles and other transportation devices to conceal the reflection and/or glint from lights, fixtures, mounting equipment and other apparatus used to secure the lights to vehicles and other transportation devices from other people or other viewing devices that may view the vehicle or other transportation devices, while allowing the person(s) operating the vehicle or other transportation devices equipped with camouflage light covers to have an unobstructed field of vision.

The covers comprise a material having an inside and an outside portion, the outside portion being visible to others viewing the lights of the vehicle or transportation devices; the inside portion allowing light to penetrate the covers unobstructed. A camouflage design is formed on the outside portion of the covers so that the design is visible while viewing the lights, fixtures, mounting equipment, and other apparatus used to secure the lights, thus concealing the lights, fixtures, mounting equipment, and other apparatus used to secure the lights, thus concealing the lights, fixtures, mounting equipment, and other apparatus used to secure the lights of the vehicle(s) and other transportation devices. In contrast, light will penetrate the covers unobstructed.

Another feature of the present invention is that the covers are preferably non-reflecting so that the reflection of the sun from the covers will not give away the position of the person desiring not to be seen.

The design applied is a "camouflage" pattern. A camouflage pattern is a pattern comprised of shapes and colors intended to blend into the surrounding environment in order to conceal. The camouflage pattern can be comprised of brown, green, orange, black, white, and/or blue shades etc. and combinations thereof, and any color that blends into the terrain in which something is being concealed. The colors and shapes employed will depend on the season of the year as well as the terrain.

To make the inventive device, a camouflage pattern is applied to the outer portion of the covers. The pattern is preferably applied by the method taught in Hill, U.S. Pat. No. 4,673,609. The pattern can comprise as many different colors as needed to adequately blend into the surrounding environment. The construction should also include other material such as burlap and honeycomb perforated designs or constructions. As in any type of camouflage covering, whether it be on clothes, vehicles or instruments, the colors and patterns are varied depending on the environment and season.

In the present invention, the camouflage design is applied to a transparent or translucent material that is suitable for making panels used for the camouflage light covers. Transparent or translucent material includes but is not limited to acrylic sheets, polycarbonate sheets, polyester film, polychloride film, or any other plastic suitable for making transparent material used for making the light covers. The lens cover can be constructed of alternative materials such as burlap and honeycomb perforated designs or constructions.

The formation of camouflage designs of different colors on the lens is preferably applied using the process disclosed in U.S. Pat. No. 4,673,609, herein incorporated by reference. However, other suitable methods that may be used are disclosed in U.S. Pat. No. 4,715,702, and British Patents 2,032,417A and 2,118,096, each of the above are herein incorporated by reference.

The unidirectional panels as disclosed in U.S. Pat. No. 4,673,609 comprise an opaque pattern of dots or discreet print elements, 1 mm in diameter and at a distance of 1.4 mm between the centers of the adjacent dots on a square grid appearing white from one side and black from the other side, the other side being less illuminated that the one side. Light incident on the white dots is reflected and scattered, which has the effect of obscuring visibility from one side into the other side. However, a substantially clear view is obtained from the other side through the panels into the one side, the intensity of light of the image is reduced by virtue of the degree of opacity, giving a toned down effect to the image, similar to tinted transparent panels.

The general purpose of the present invention, which will be described subsequently in greater detail, is to provide a new Camouflage Light Cover apparatus and method which has many of the advantages of the lens covers, blinds, shades, and the like mentioned heretofore and many novel features that result in a new Camouflage Light Cover which is not anticipated, rendered obvious, suggested, or even implied by any of the prior art lens covers, blinds, shades, and the like, either alone or in any combination thereof.

To attain this, the present invention generally comprises a lens cover, a snap-on attachment means, a spring system, pressure standoffs, and heat dissipating standoffs, and is quickly removable when absolutely necessary. The lens cover can be constructed of alternative materials such as burlap and honeycomb perforated designs or constructions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Camouflage Light Cover apparatus and method which has many of the advantages of the lens covers, blinds, shades, and the like mentioned heretofore and many novel features that result in a new Camouflage Light Cover which is not anticipated, rendered obvious, suggested, or even implied by any of the prior art lens covers, blinds, shades, and the like, either alone or in any combination thereof. Examples of printed light covers could include, but would not be limited to, collegiate and professional sports logos, numbers, corporate logos and other printed art work.

It is another object of the present invention to provide a new Camouflage Light Cover which may be easily and efficiently manufactured and marketed.

It is a further object of the present invention to provide a new Camouflage Light Cover which is of a durable and reliable construction.

An even further object of the present invention is to provide a new Camouflage Light Cover which is susceptible of a low cost of manufacture with regard to both materials and labor, and which accordingly is then susceptible of low prices of sale to the consuming public, thereby making such Camouflage Light Cover economically available to the buying public.

Still yet another object of the present invention is to provide a new Camouflage Light Cover which provides in the apparatuses and methods of the prior art some of the advantages thereof, while simultaneously overcoming some of the disadvantages normally associated therewith.

Still another object of the present invention is to provide a new Camouflage Light Cover for offering a device which disguises headlights and lenses of a vehicle such as a military vehicle, hunting vehicle, ATV, or the like.

Yet another object of the present invention is to provide a new Camouflage Light Cover which includes a lens cover, a snap-on attachment means, a spring system, pressure standoffs, and heat dissipating standoffs, and is quickly removable when absolutely necessary.

Still yet another object of the present invention is to provide a new Camouflage Light Cover that does not reveal the location of the vehicle to which it is installed.

Even still another object of the present invention is to provide a new Camouflage Light Cover that will stay durably fastened to the vehicle while allowing adequate visibility even when the vehicle is traveling at high speeds and in inclement weather conditions such as driving 50 miles per hour at night and in the rain.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
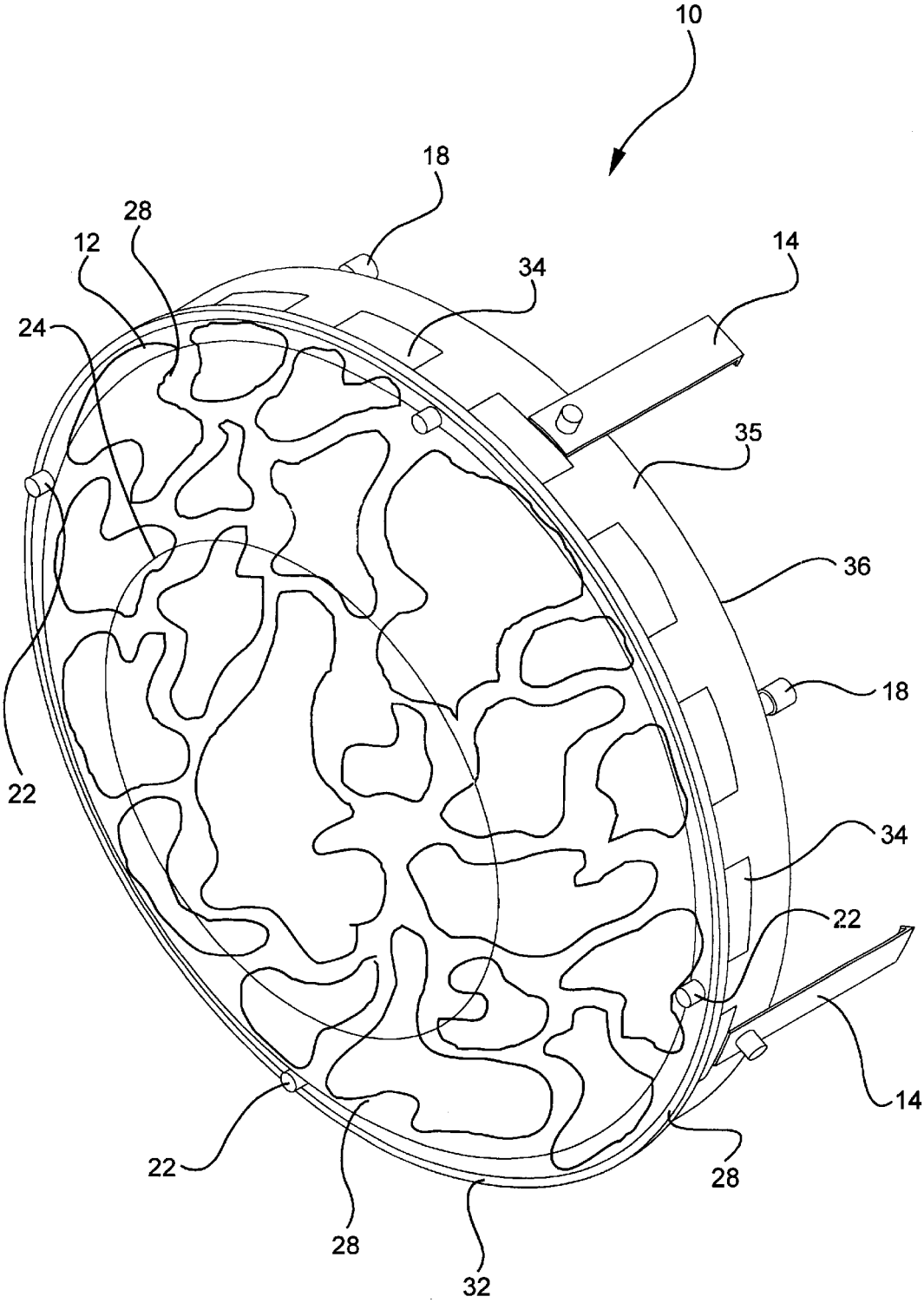
FIG. 1 is a front side perspective view of a new Camouflage Light Cover according to the present invention.
Figure 2:
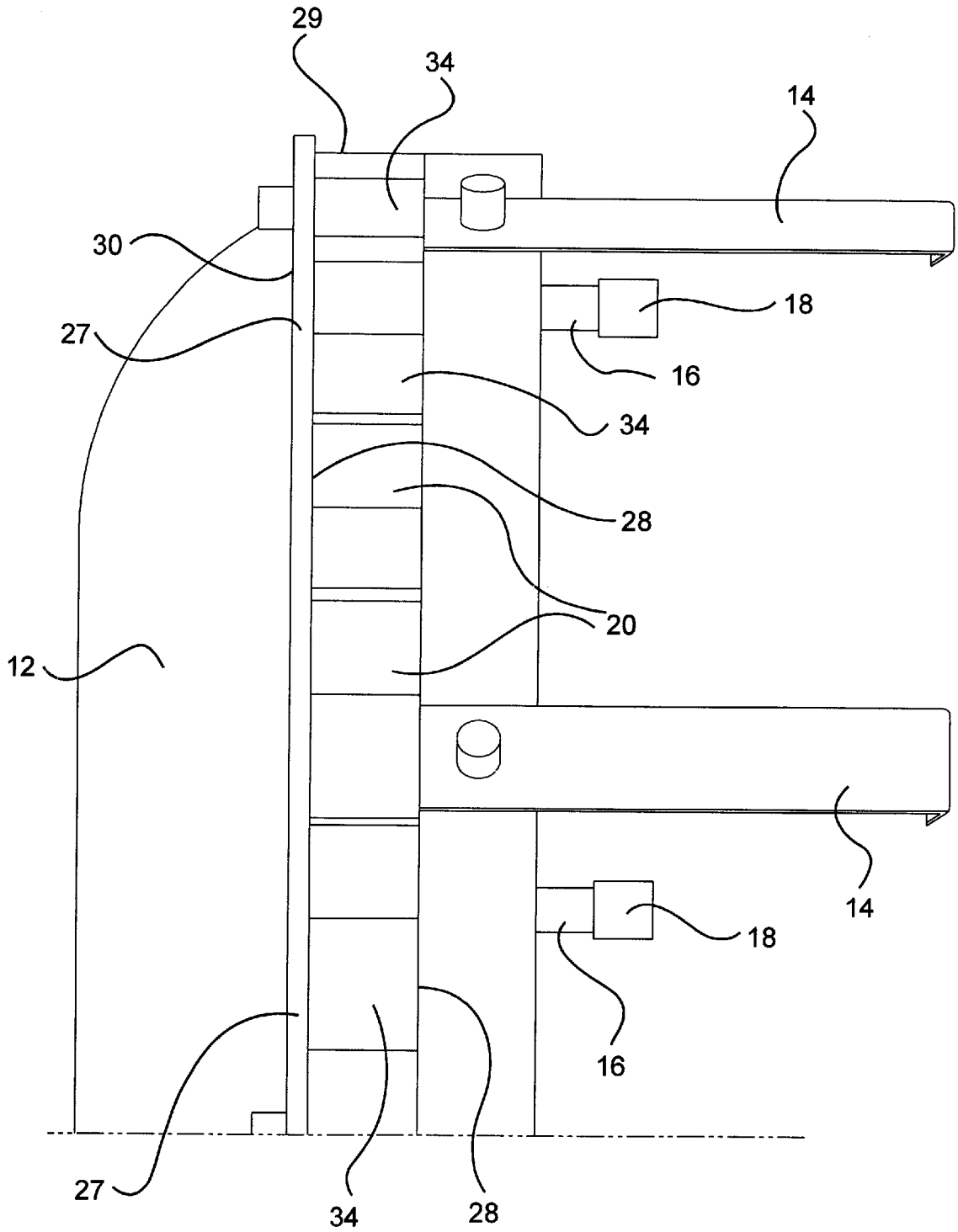
FIG. 2 is a side elevation view thereof.

With reference now to the drawings, and in particular to FIGS. 1 and 2 thereof, a new Camouflage Light Cover embodying the principles and concepts of the present invention and generally designated by the reference numeral 10 will be described.

More specifically, it will be noted that the Camouflage Light Cover 10 comprises a lens cover 12, a snap-on attachment means 14, a spring system 16, pressure standoffs 18, and heat dissipating standoffs 20, wherein the lens cover 12 is attached to the and heat dissipating standoffs 20 by a cover attachment means 22 and where the heat dissipating standoffs 20 also have the snap-on attachment means 14 and the pressure standoffs 18 permanently affixed thereto and where the spring system 16 is workingly supported by the pressure standoffs 18 and work to biasly extend the pressure standoffs 18 out and away from the heat dissipating standoffs 20 and where the Camouflage Light Cover 10 is quickly removably attached to a vehicle by use of the snap-on attachment means 14. Military vehicles prefer rounded edges to reduce reflections and said rounded edges matingly receive the snap-on attachment means 14. The spring system 16, by biasly applying outward force, therefore keeps the Camouflage Light Cover 10 snug and tight and free from rattling when installed on a vehicle.

As best illustrated in FIGS. 1 and 2, it can be shown that the lens cover 12 further includes a rigidity crease 24 which is further defined as a concentrical formation with a circumferential vertex oriented toward a vehicle side of the Camouflage Light Cover 10 and is for the purpose of providing strength to the lens cover 12 to deter vibration of the lens cover 12.

Additionally, the lens cover 12 further includes a radial channel 26 having a lens wall 27, a mounting flange wall 28, a channel wall 29, and a radially outwardly extending edge 30 wherein the radial channel 26 is a radially integral continuous extension of the lens cover 12 wherein the lens wall 27 is an inwardly extending wall connecting the mounting flange wall 28 to the lens cover 12 and the mounting flange wall 28 is a radial extension normal to the lens wall 27 and provides a substantially flat mounting ring in a plane parallel to the lens cover 12 and the heat dissipating standoffs 20 and where the mounting flange wall 28 then becomes the channel wall 29 which is an outwardly extending wall connecting the mounting flange wall 28 to the radially outwardly extending edge 30 wherein the channel wall 29 is normal to the mounting flange wall 28 and the radially outwardly extending edge 30 is normal to the channel wall 29.

The heat dissipating standoffs 20 are further defined as an annular ring 32 having at least one aperture 34 on a lens side 35 and a continuous surface on a base side 36 where the annular ring 32 has at least one of the snap-on attachment means 14 fixedly attached to it and has at least one of the pressure standoffs 18 fixedly attached to it wherein both the snap-on attachment means 14 and the pressure standoffs 18 extend in a direction toward the base side 36.

The heat dissipating standoffs 20 are preferably constructed of aluminum or other suitable material such as hard plastic and the snap-on attachment means 14 is preferably made of spring steel and where the heat dissipating standoffs 20 allow heat generated by the head lights to escape by natural convection and air flow generated by the vehicle when it is in motion.

The snap-on attachment means 14 and the pressure standoffs 18 are preferably, each, four in number and are interlappingly and symmetrically placed around a circumference of the Camouflage Light Cover 10 and in particular the annular ring 32 of the heat dissipating standoffs 20.

The pressure standoffs 18 adjustably offer a range of force and therefore also accommodate a range of head light rim thicknesses and also therefore prevent the Camouflage Light Cover 10 from rattling vibration when the vehicle is in motion.

In use, when lights on the vehicle having Camouflage Light Covers 10 are on, a local glow right in front of the vehicle results. This local glow, however, is still adequate for substantially 50 mph driving at night in rain. The Camouflage Light Covers 10 are assembled to the vehicle by use of an axial force from the lens side 35 toward the base side 36. The Camouflage Light Covers 10 are disassembled from the vehicle by use of an axial pull from the base side 36 toward the lens side 35 in conjunction with a radial pull on all of the snap-on attachment means 14 on one semicircular side of the head light.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A camouflage light cover comprising: a lens cover, a snap-on attachment means, a spring system, pressure standoffs, and heat dissipating standoffs, wherein the lens cover is attached to the heat dissipating standoffs by a cover attachment means and where the heat dissipating standoffs also have the snap-on attachment means and the pressure standoffs permanently affixed thereto and where the spring system is workingly supported by the pressure standoffs and work to biasly extend the pressure standoffs out and away from the heat dissipating standoffs and where the camouflage light cover is quickly removably attached to a vehicle by use of the snap-on attachment means.

2. The camouflage light cover of claim 1, wherein vehicles prefer rounded edges to reduce reflections and said rounded edges matingly receive the snap-on attachment means.

3. The camouflage light cover of claim 2, wherein the spring system, by biasly applying outward force, therefore keeps the camouflage light cover snug and tight and free from rattling when installed on a vehicle.

4. The camouflage light cover of claim 3, wherein the lens cover further includes a rigidity crease which is further defined as a concentrical formation with a circumferential vertex oriented toward a vehicle side of the camouflage light cover and is for the purpose of providing strength to the lens cover to deter vibration of the lens cover.

5. The camouflage light cover of claim 4, wherein the lens cover further includes a radial channel having a lens wall, a mounting flange wall, a channel wall, and a radially outwardly extending edge wherein the radial channel is a radially integral continuous extension of the lens cover wherein the lens wall is an inwardly extending wall connecting the mounting flange wall to the lens cover and the mounting flange wall is a radial extension normal to the lens wall and provides a substantially flat mounting ring in a plane parallel to the lens cover and the heat dissipating standoffs and where the mounting flange wall then becomes the channel wall which is an outwardly extending wall connecting the mounting flange wall to the radially outwardly extending edge wherein the channel wall is normal to the mounting flange wall and the radially outwardly extending edge is normal to the channel wall.

6. The camouflage light cover of claim 5, wherein the heat dissipating standoffs are further defined as an annular ring having at least one aperture on a lens side and a continuous surface on a base side where the annular ring has at least one of the snap-on attachment means fixedly attached to it and has at least one of the pressure standoffs fixedly attached to it wherein both the snap-on attachment means and the pressure standoffs extend in a direction toward the base side.

7. The camouflage light cover of claim 6, wherein the heat dissipating standoffs are preferably constructed of aluminum and the snap-on attachment means is preferably made of spring steel and where the heat dissipating standoffs allow heat generated by the head lights to escape by natural convection and air flow generated by the vehicle when it is in motion.

8. The camouflage light cover of claim 7, wherein the snap-on attachment means are four in number and are symmetrically placed around a circumference of the camouflage light cover and in particular the annular ring of the heat dissipating standoffs.

9. The camouflage light cover of claim 8, wherein the pressure standoffs are four in number and are symmetrically placed around the circumference of the camouflage light cover and in particular the annular ring of the heat dissipating standoffs.

10. The camouflage light cover of claim 9, wherein the snap-on attachment means and the pressure standoffs are interlappingly and symmetrically placed around a circumference of the camouflage light cover and in particular the annular ring of the heat dissipating standoffs.

11. The camouflage light cover of claim 10, wherein the pressure standoffs adjustably offer a range of force and therefore also accommodate a range of head light rim thicknesses and also therefore prevent the camouflage light cover from rattling vibration when the vehicle is in motion.

12. The camouflage light cover of claim 11, wherein when lights on the vehicle having camouflage light covers are on, a local glow right in front of the vehicle results, wherein said local glow is still adequate for substantially 50 mph driving at night in rain and wherein said camouflage light covers are assembled to the vehicle by use of an axial force from the lens side toward the base side and wherein said camouflage light covers are disassembled from the vehicle by use of an axial pull from the base side toward the lens side in conjunction with a radial pull on all of the snap-on attachment means on one semicircular side of the head light.

* * * * *